US006588133B1

(12) United States Patent
Garrity

(10) Patent No.: US 6,588,133 B1
(45) Date of Patent: Jul. 8, 2003

(54) VEHICLE BANNER ASSEMBLY

(76) Inventor: George M. Garrity, 67 Wildwood La., Kensington, CT (US) 06037

( * ) Notice: Subject to any disclaimer, the term of this patent is extended or adjusted under 35 U.S.C. 154(b) by 0 days.

(21) Appl. No.: 09/899,887

(22) Filed: Jul. 6, 2001

Related U.S. Application Data

(60) Provisional application No. 60/259,118, filed on Dec. 29, 2000, and provisional application No. 60/220,619, filed on Jul. 25, 2000.

(51) Int. Cl.[7] ..... G09F 21/04
(52) U.S. Cl. ..... 40/591; 40/603
(58) Field of Search ..... 40/591, 603, 604; 160/382, 383, 395, 403

(56) References Cited

U.S. PATENT DOCUMENTS 2,201,002 A * 5/1940 Theriault ..... 40/591
2,214,302 A * 9/1940 Keller et al. ..... 40/591
2,675,983 A * 4/1954 King ..... 40/591
3,255,542 A * 6/1966 De Vane ..... 40/591
3,461,584 A * 8/1969 Wilson ..... 40/591
3,701,210 A * 10/1972 Smith ..... 40/591
4,628,624 A * 12/1986 Gunn ..... 40/591
5,667,648 A * 9/1997 McDonald ..... 204/245

* cited by examiner

*Primary Examiner*—Cassandra H. Davis
(74) *Attorney, Agent, or Firm*—Alix, Yale & Ristas, LLP

(57) ABSTRACT

A vehicle banner assembly employs a continuous leading edge attachment and elastic bands to stretch and display a banner on the door of a vehicle. The vehicle banner assembly permits easy removal of the banner and is constructed of plastic materials that do not damage the finish of the vehicle. The vehicle banner assembly permits the user to adjust the length of the banner to accommodate variations in the size of vehicle doors.

18 Claims, 7 Drawing Sheets

VEHICLE BANNER ASSEMBLY

CROSS REFERENCE TO RELATED APPLICATIONS

This application claims the priority of U.S. Provisional Application No. 60/220,619 filed Jul. 25, 2000 and U.S. Provisional Application No. 60/259,118 filed Dec. 29, 2000.

BACKGROUND OF THE INVENTION

1. Field of the Invention

This invention relates generally to the placement of advertising and signs on vehicles. More particularly, this invention relates generally to advertising display banners that temporarily but securely attach to the door of a motor vehicle.

2. Description of the Related Art

The attendance of professional sporting events including auto racing events and football games is at record levels. Many fans have particular teams, players, brands or drivers whom they follow and support. Various products related to the team, brand, player or driver are available which allow the fan to display their support. These products include T-shirts, bumper stickers, decals, posters, flags, pennants, hats and the like. Frequently, fans attending a particular event purchase event related memorabilia and display that memorabilia in or on their motor vehicle.

It is well known to display advertising on the exterior of motor vehicles. Typically the advertising is painted on the exterior. Magnetic signs that stick to the body panels of motor vehicles are also known. Various adhesive backed printed materials, such as bumper stickers, are also known in the art. Painted or adhesive products have the disadvantage of permanently altering the exterior finish of the motor vehicle. Magnetic signs may be bulky and also have the potential to damage the finish of the body panel to which they are applied.

Additionally, the bumper sticker or decal typically has a very limited size. The size is limited by the permanent or semi-permanent nature of a decal or sticker. The typical fan does not want to permanently alter the exterior appearance of their car or truck with a large sticker or decal. A large magnetic type sign can be expensive and has the major disadvantage of likely scratching the paint of the body panel to which it is secured.

Accordingly, there is a need in the art for a large surface area display apparatus that can be securely but temporarily attached to the exterior of a motor vehicle. The display apparatus should not result in damage to the motor vehicle finish and be inexpensive to produce.

SUMMARY OF THE INVENTION

A preferred embodiment of the invention comprises a banner and means for affixing the banner to the door of a motor vehicle. The banner may vary in size but is preferably configured to cover most of the door, or at least the upper half of the door. The banner is securely attached to the door at both the hinge edge and the entry edge of the door. At the hinge edge of the door the banner includes a pocket along the leading edge of the banner. A flexible retaining cable is trapped within the pocket. The pocket and retaining cable are inserted between the hinge edge and the trailing edge of the front fender when the door is partially open or closed. Plastic hooks attached or sewn to the banner are hooked over the hinge edge of the door to hold the banner assembly in place while the driver fully opens the door during entry.

Closing the door traps the retaining cable between the hinge edge of the door and the trailing edge of the fender, securely retaining the entire leading edge of the banner. The flexible retaining cable and banner material conform to the shape of the door profile, permitting the banner to be displayed in a close fitting relationship with the door. The trailing edge of the banner is equipped with elastic bands and soft plastic hooks that engage the entry edge of the door.

Alternatively, a hook is molded or extruded as a continuous, flexible strip similar to an automobile door edge molding. Affixed to the continuous hook are means for engaging the leading edge of the banner. The trailing edge of the banner may be equipped with similar, though shorter, hooks affixed to the banner by elastic bands. The banner is stretched across the door and retained in place by the elastic bands and/or the elastic properties of the banner itself.

The advertisement, promotional message or display is printed on thin, flexible material such as plastic film. Similar banners are routinely used in advertising. Textile materials, coated paper or paper-like materials may also be appropriate. Such banners may be mass-produced at low cost per unit. The leading and trailing edges of the banner may provide excess material to accommodate differences in the size and shape of motor vehicle doors. The banner and attachment hooks may be packaged and sold as a kit.

An object of the present invention is to provide a new and improved vehicle banner assembly which may be securely affixed to the door of a motor vehicle and easily removed without damage to the motor vehicle finish.

Another object of the present invention is to provide a new and improved vehicle banner assembly that may be cost effectively produced in large quantities.

A yet further object of the present invention is to provide a new and improved vehicle banner assembly which includes a display area approximately the size of a vehicle door.

A still further object of the present invention is to provide a new and improved vehicle banner assembly that may be used with a wide variety of vehicle types, makes and models.

These and other objects, features, and advantages of the invention will become readily apparent to those skilled in the art upon reading the description of the preferred embodiments, in conjunction with the accompanying drawings.

DETAILED DESCRIPTION OF THE PREFERRED EMBODIMENT

Figure 1:
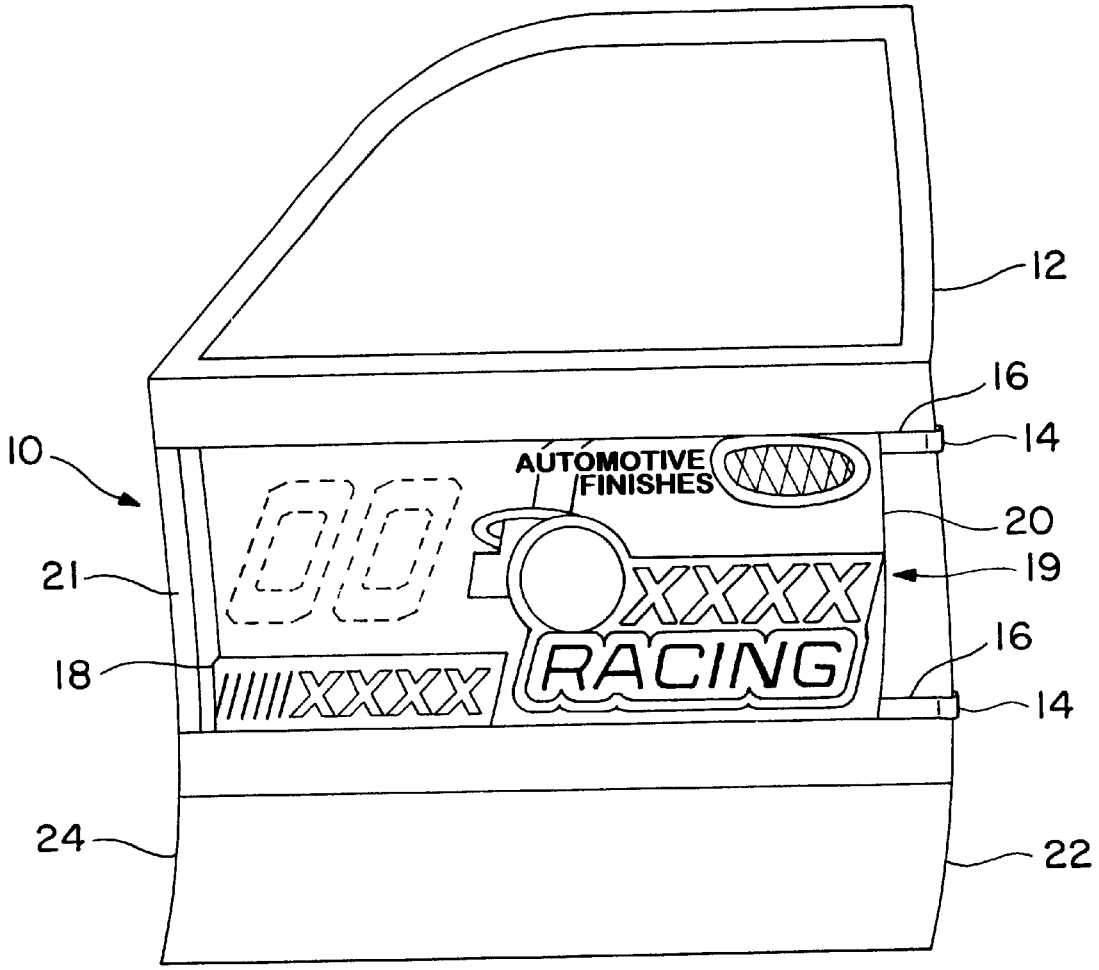
FIG. 1 is a side view of a vehicle door displaying a vehicle banner assembly in accordance with the present invention.

With reference to FIGS. 1–7, wherein like numerals refer to similar parts, a first embodiment of the vehicle banner assembly in accordance with the present invention is designated by the numeral 10. FIG. 1 illustrates a vehicle banner assembly 10 installed on a representative door 12 of a motor vehicle.

The banner is made of a thin, flexible, inexpensive yet durable material such as polyethylene plastic sheet. Certain textiles, coated paper products or paper-like sheet materials, such as Tyvek® material, may also be appropriate. The sheet material will preferably have some elastic properties as well. A promotional message, symbol and/or advertisement is printed on at least one side of the sheet 20. The banner has a leading edge 18 secured to the hinge edge 24 of the door 12 and a trailing edge 19 secured to the entry edge 22 of the door.

Figure 2:
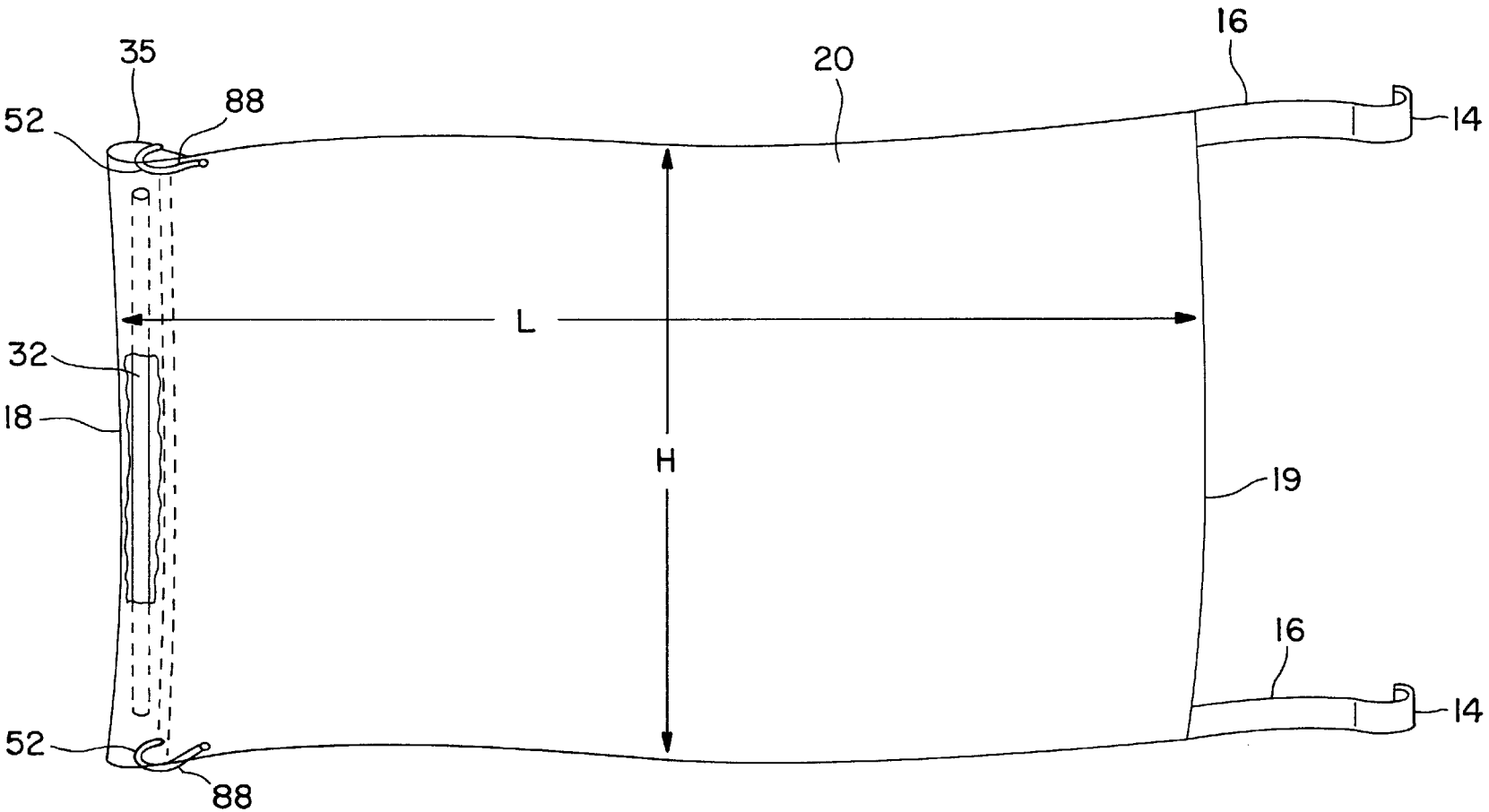
FIG. 2 is a perspective side view of a first embodiment of a vehicle banner assembly in accordance with the present invention, partially in phantom and partially broken away.

FIG. 2 illustrates a first preferred embodiment of the vehicle banner assembly 10. In this embodiment, a pocket 35 is included along substantially the entire leading edge 18 of the banner. An elongate retainer 32 is enclosed in the pocket 35 by stitching 52. The elongate retainer 32 can be formed of any material that is flexible and retains enough rigidity to become trapped between the hinge edge 24 of the door and the trailing edge of the vehicle fender (not illustrated). Examples of appropriate materials for use as elongate retainers include rubber tubing, electrical cable, foam strips, and the like. Plastic hooks 88 attached or sewn to the banner are hooked over the hinge edge of the door to hold the banner assembly in place while the driver fully opens the door during entry. This method of securing the leading edge 18 of the vehicle banner assembly to the door 12 of a vehicle has proven to be simple and inexpensive to manufacture, adaptable to a wide variety of vehicle styles, and secure yet non-damaging to vehicle finishes.

Figure 3:
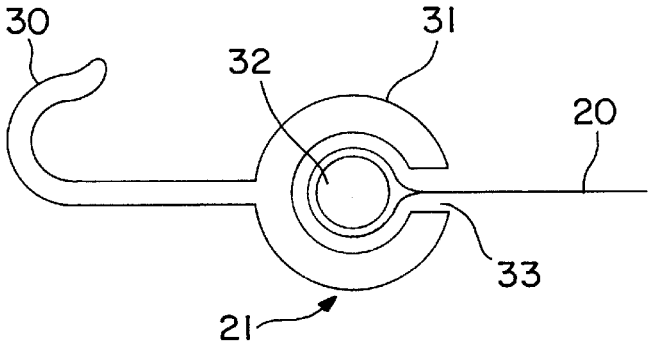
FIG. 3 is an enlarged top view of a first embodiment of an edge hook for use in conjunction with a vehicle banner assembly in accordance with the present invention, illustrated in functional relationship with a vehicle banner (partially illustrated)
Figure 4:
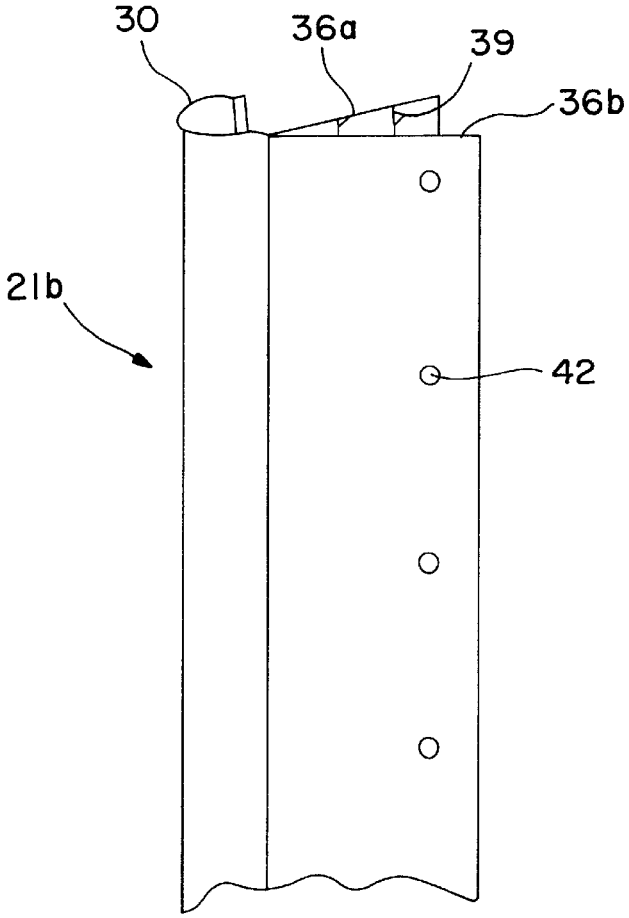
FIG. 4 is an enlarged partial perspective side view of a second embodiment of an edge hook for use in conjunction with a vehicle banner assembly in accordance with the present invention.
Figure 5:
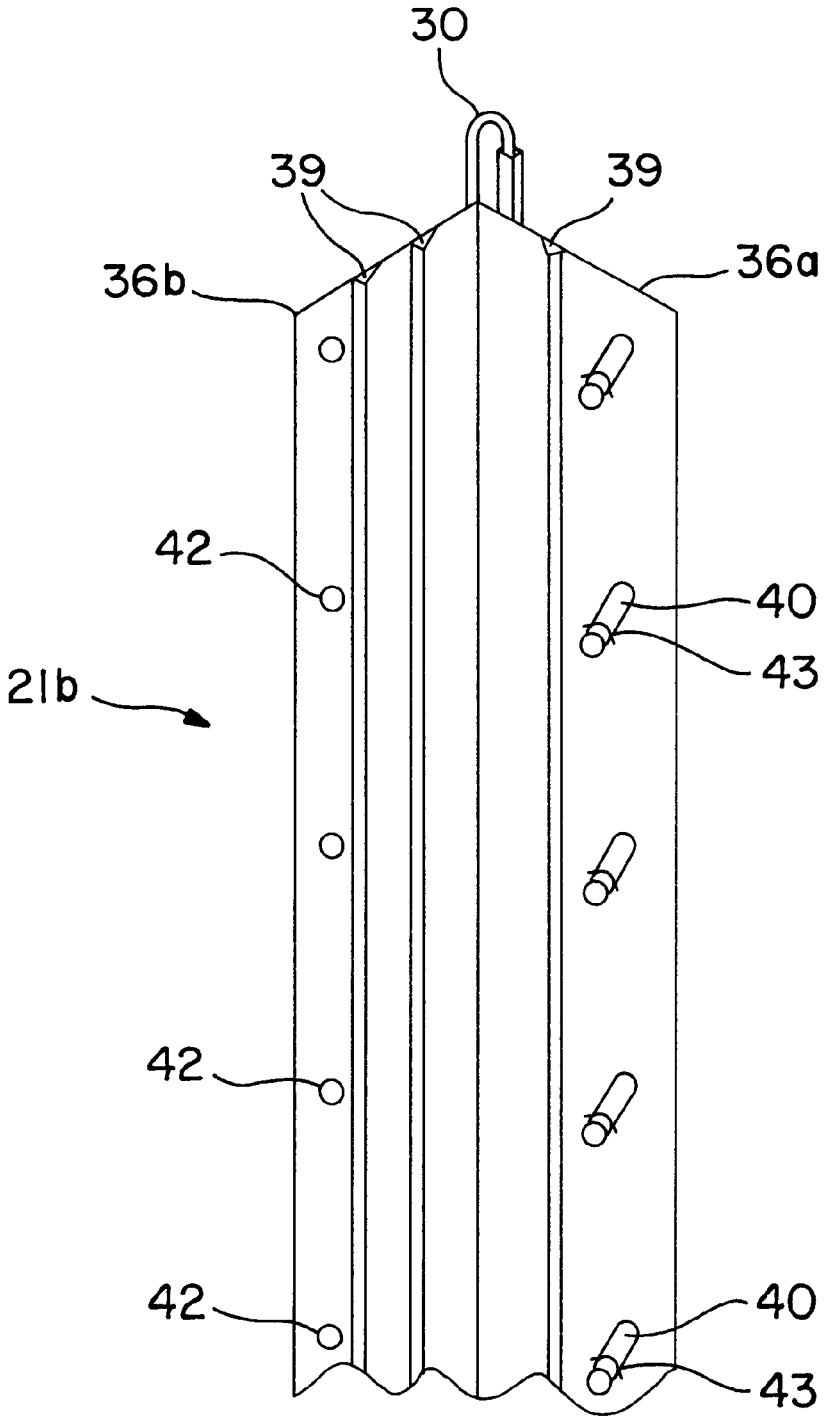
FIG. 5 is an enlarged partial perspective rear view of the edge hook of FIG. 4.

Alternatively, the leading edge 18 of the vehicle banner assembly 10 is secured to the hinge edge 24 by a continuous strip-like edge hook 21. The edge hook 21 is constructed of tough, flexible plastic material that is soft enough to protect the paint finish of the vehicle door and conform to the contour (bulge) of the door. FIG. 3 is a top view of a first embodiment of an edge hook 21. The edge hook 21 includes a hook-shaped edge catch 30 and a tubular body 31. The edge catch 30 is preferably equipped with a flared hook-shape, which allows for easy installation over the hinge edge 24 of the door 12 (particularly when the door is closed). The edge hook body 31 includes an opening 33 that traverses the length of the edge hook 21. The edge hook 21 preferably has a length equal to the height of the banner 20, which is approximately 12 to 18 inches and preferably approximately 15 inches. The edge hook may be conveniently formed by known plastic forming techniques, such as extrusion or molding.

The vehicle banner assembly illustrated in FIG. 2 may be equipped with the edge hook 21 of FIG. 3. The leading edge 18 of the banner 20 is formed into a pocket 35 by turning the banner material back and bonding the material together by sewing, heat bonding or similar means. With reference to FIG. 3, the leading edge pocket 35 with its captured elongate retainer 32 is inserted into the hook body 31. The elongate retainer 32 expands the pocket 35 and secures the leading edge 18 of the banner 20 within the edge hook 21.

Alternatively, the pocket 35 may be left open at one or both ends to permit the leading edge 18 and its pocket 35 to be inserted into the edge hook body 31 through opening 33 and then expanded by insertion of the elongate retainer 32. In this arrangement, the elongate retainer 32 preferably incorporates a head (not illustrated) or other means sufficient to keep the retaining rod 32 from slipping out of the hollow hook body 31.

Elastic bands 16, which terminate in rear hooks 14, extend rearwardly from the trailing edge 19 of the banner 20. Preferred materials for the elastic bands include polyester/rubber composite elastic in widths of approximately 1 inch. Other materials will also be suitable.

Figure 9:
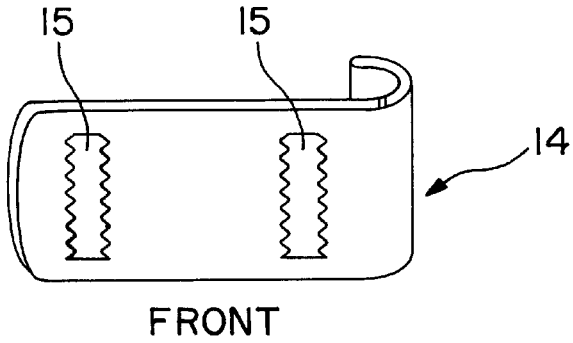
FIG. 9 is an enlarged front perspective view of an embodiment of a rear hook suitable for use in conjunction with the vehicle banner assembly illustrated in FIGS. 1 and 2.
Figure 10:
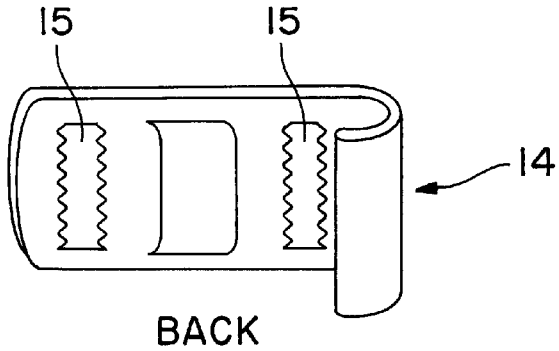
FIG. 10 is a rear perspective view of the rear hook of FIG. 9.
Figure 11:
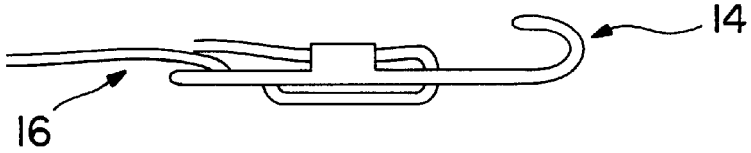
FIG. 11 is a top view of the rear hook of FIG. 9, illustrated in functional conjunction with an elastic band as illustrated in FIGS. 1 and 2.

FIGS. 9–11 illustrate one possible preferred embodiment of a rear hook 14. The rear hook 14 is provided with openings 15 through which the elastic band 16 is threaded and adjustably retained. This rear hook configuration permits the length of the elastic bands 16 to be easily adjusted to fit the particular vehicle door on which the banner will be displayed. With the leading edge 18 of the banner 20 secured to the hinge edge 24 of a vehicle door 12, the elastic bands 16 are stretched and the rear hooks are attached over the entry edge 22 of the door. In this manner, the vehicle banner assembly 10 is easily and securely displayed over a vehicle door. Of course, non-elastic bands may also be used.

Figure 8:
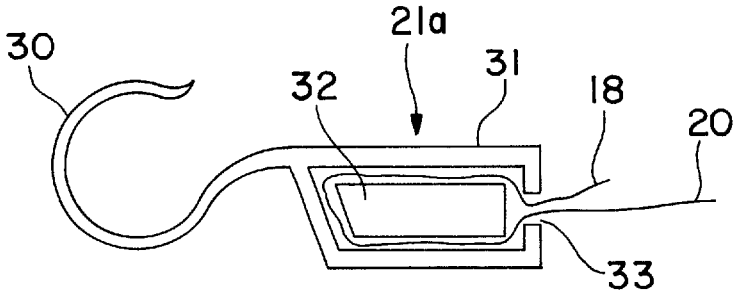
FIG. 8 is an enlarged top view of a third embodiment of an edge hook for use in conjunction with a vehicle banner assembly in accordance with the present invention, illustrated in functional relationship with a vehicle banner (partially illustrated)

It should be understood that the configuration of the edge hook edge catch 30, body 31 and elongate retaining element 32 may assume numerous forms. An alternative configuration of an edge hook is illustrated in FIG. 8. Edge hook 21*a* includes a rhombus-shaped body 31 in which a similarly shaped retention rod 32 is inserted to retain the leading edge 18 of the banner 20. An opening 33 traverses the length of the edge hook 21*a* through which a folded edge of the banner material may be inserted. In this alternative configuration, the edge hook body 31 is extruded (or molded) to flexibly clamp over the banner material and the retaining rod 32. The clamped relationship between the banner 20, retaining rod 32 and edge hook body 31, permits the user to configure the overall length L of the installed banner. A pre-formed loop is no longer required. The edge hook body 31 and/or the elongate retaining element 32 may include ribs or other protrusions to further engage the banner material. The elongate retaining element 32 may be tapered at one end to aid in assembly.

Figure 6:
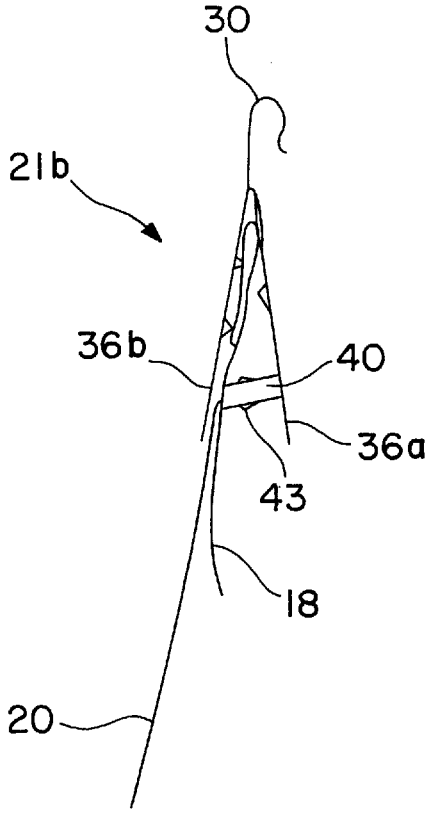
FIG. 6 is a top view of the edge hook of FIG. 4 partially closed over an edge of a vehicle banner (partially illustrated)
Figure 7:
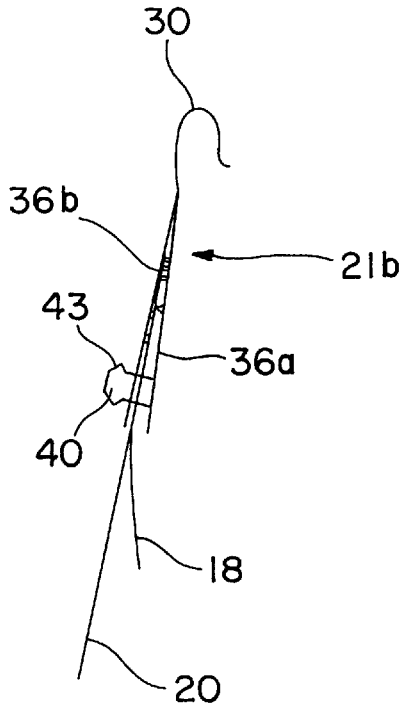
FIG. 7 is a top view of the edge hook of FIG. 4 completely closed over an edge of a vehicle banner (partially illustrated)

A yet further embodiment of an edge hook is illustrated in FIGS. 4–7. Edge hook 21*b* includes an edge catch 30 and a hinged body 36*a*, 36*b*. The V-shaped body has two wings 36*a*, 36*b* configured to clamp over the folded leading edge 18 of the banner 20. One wing 36*a* includes retention ribs 39 and protruding engagement posts 40. The opposed wing 36*b* includes complementary retention ribs 39 and holes 42 for receiving the engagement posts 40. FIGS. 6 and 7 illustrate the folded leading edge 18 of a banner 20 inserted between the open wings 36*a*, 36*b* of the edge hook 21*b*. The wings 36*a*, 36*b* are then closed over the folded leading edge 18. When closed together, the opposed, complementary retention ribs 39 engage and retain the folded leading edge 18. The engagement posts 40 pierce the banner material of the folded leading edge 18 and pass through the holes 42, further retaining the folded edge 18. The wings 36*a*, 36*b* are retained in a closed relationship by protrusions 43 on the engagement posts 40. The wings essentially snap together over the folded leading edge 18 of the banner 20. This embodiment of edge hook 21*b* ensures the banner is easily custom adjusted for length by the user and securely retained along the entire leading edge 18 within the edge hook 21*b*.

Figure 12:
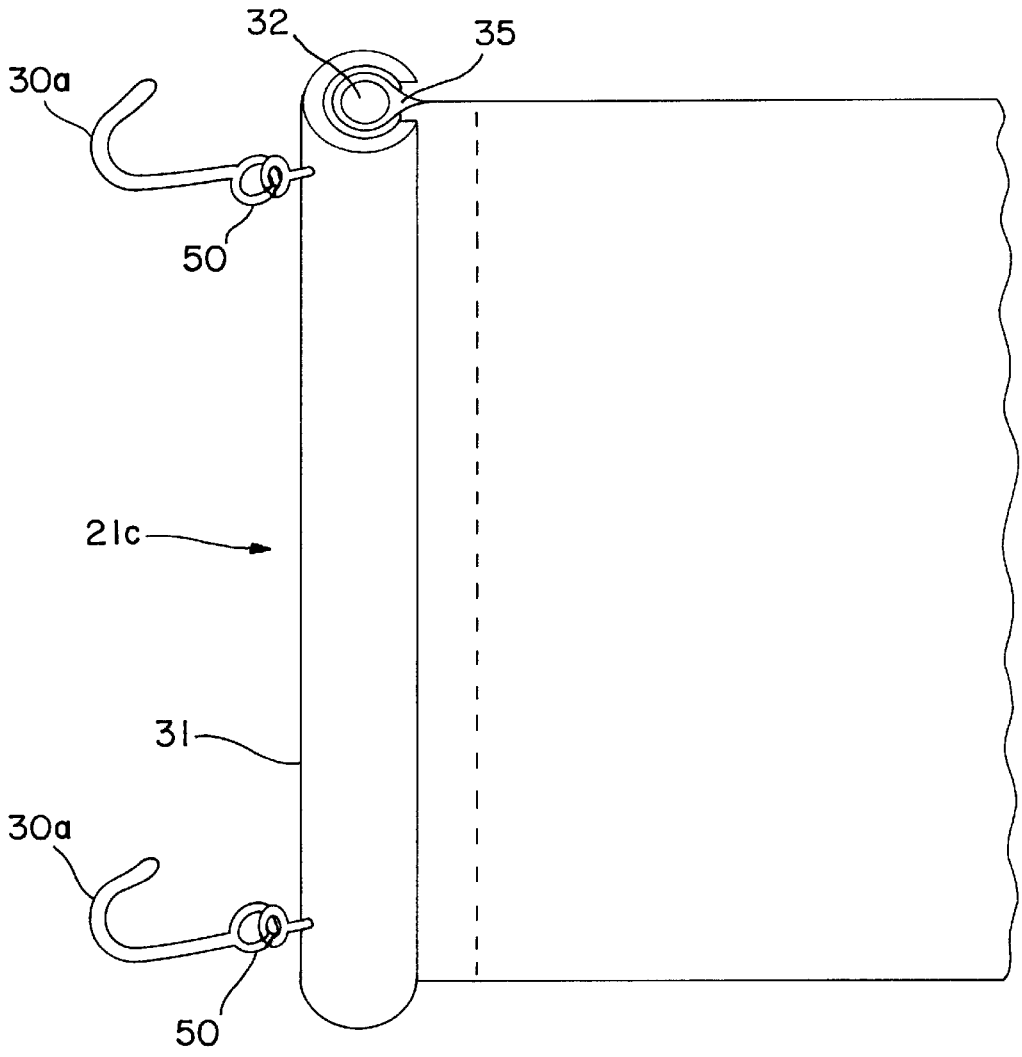
FIG. 12 is a further alternative embodiment of an edge hook for use in conjunction with a vehicle banner assembly in accordance with the present invention.

FIG. 12 illustrates a variation of the edge hook of FIG. 3. This edge hook 21*c* includes discrete edge catches 30*a* that are attached to the edge hook body 31 by an articulating link 50. In this edge hook, the edge catch 30*a* is free to rotate and pivot at the articulating link 50. This flexibility permits the edge catches 30*a* and edge hook body 31 to assume whatever position is dictated by the vehicle structure. The entire edge hook may be constructed of stronger, more rigid materials, because the necessary flexibility is provided by the articulating link 50.

Short versions of the edge hook 21*b* may alternatively be used to secure the trailing edge 19 of the banner 20 to the entry edge 22 of the vehicle door 12. In such an installation, the elastic properties of the banner material will be relied upon to create tension between the opposed edge hooks to retain the banner on the door.

Secure retention of the banner along the entire leading edge is important aerodynamically because the vehicle to which the banner is secured will move through the air as it is driven. If air is allowed between the banner and the door at the leading edge, the banner will be torn from the vehicle. In this regard, the hookless attachment scheme explained in conjunction with FIG. 2 has proven to be simple, secure and non-damaging to the vehicle. Configuring the banner length L and securing the leading edge along the entire banner height H ensure proper retention of the banner on the vehicle.

Enabling the user to easily configure the banner length serves two primary purposes. User adjustability permits the production of a one size fits all banner, significantly reducing costs. In addition, the size and shape of vehicle doors vary widely and user adjustability ensures at least the opportunity for every banner to be fitted to the particular door on which it will be used.

The edge hooks and banners can be mass-produced very inexpensively. Inexpensive banners could be given away as a promotional tool. The cost of the banners could be defrayed by the sale of advertising on the banners. For example, the sponsors of an auto racing team could distribute banners free, knowing their name and logo will be prominently displayed. Alternatively, banners associated with a particular player or team might be sold as memorabilia that the fan can display on the way to and from an event. Businesses that utilize personal vehicles to deliver products or services may choose to create durable vehicle banners for display by their delivery personnel.

The inventive configuration of the vehicle banner assembly creates a large display area of approximately 15×24–30 inches. With the large size of the display area, there is room for driver/player/team identification as well as prominent display of the sponsor name and logo. Such flexibility makes the vehicle banner assembly an attractive promotional tool. The vehicle banner assembly has the additional advantage of securely attaching to the user's vehicle without damaging the vehicle finish. The vehicle banner is quickly and completely removable, leaving no trace of its use.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A vehicle and banner assembly comprising:

a motor vehicle comprising a door, said door including a hinge edge, an entry edge and an exterior surface and a body portion adjacent the hinge edge of the door; and a banner assembly comprising:

a banner constructed of thin flexible material, said banner having a height, H and leading and trailing edges separated by a length L;

leading edge fixture means for securing the leading edge of the banner to the hinge edge of the door, said fixture means comprising a pocket substantially traversing the height H of said banner and an elongated retainer received in said pocket and elongate retainer secure the leading edge of the banner to the door by being trapped between the hinge each of the door and said body portion;

adjustment means for adjusting the effective length of the banner assembly to fit the door; and trailing edge fixture means for securing the trailing edge of the banner to the entry edge of the door;

wherein said leading edge fixture means, adjustment means, and trailing edge fixture means are employed to retain said banner securely to said vehicle door and said banner generally conforms to the door exterior surface.

2. The vehicle and banner assembly of claim 1, wherein said adjustment means comprises elastic bands affixed to the trailing edge of said banner.

3. The vehicle and banner assembly of claim 1, wherein said adjustment means comprises non-elastic bands, the length of said bands being adjustable.

4. The vehicle and banner assembly of claim 1, wherein said trailing edge fixture means comprises rear hooks configured for hooked engagement with the entry edge of the door, said rear hooks connecting with the trailing edge of said banner.

5. The vehicle and banner assembly of claim 1 wherein said height H is approximately 15 inches.

6. A vehicle banner assembly for display on a door of a motor vehicle, said door including a hinge edge, an entry edge and an exterior surface, said vehicle banner assembly comprising:

a banner constructed of thin flexible material said banner having a height H and leading and trailing edges separated by a length L;

leading edge fixture means for securing the leading edge of the banner to the hinge edge of the door, wherein said leading edge fixture means comprises an edge hook having a length approximately equal to the height H of said banner, said edge hook including an edge catch traversing said length and a hook body, said edge hook configured for hooked engagement with the hinge edge of the door, and said hook body configured to receive and securely retain the leading edge of said banner;

adjustment means for adjusting the length of the banner assembly to fit the door; and trailing edge fixture means for securing the trailing edge of the banner to the entry edge of the door;

wherein said leading edge fixture means, adjustment means, and trailing edge fixture means are employed to retain said banner securely to said vehicle door and said banner generally conforms to the door exterior surface.

7. The vehicle banner assembly of claim 6, wherein said edge hook body is hollow and extends the length of said edge hook, said body including a slot traversing the length of said body and said vehicle banner assembly further comprises an elongate retainer, wherein said leading edge is inserted through said slot and said elongate retainer is inserted into said hollow body, whereby said leading edge is retained in said body.

8. The vehicle banner assembly of claim 6, wherein said edge hook body comprises two hinged wings, each said wing equipped with means for retaining the leading edge of said banner between said wings and means for retaining one wing to the other wing, wherein said leading edge of said banner is inserted between said wings and said wings are closed, whereby said.

9. The vehicle banner assembly of claim 6, wherein said edge catch is flared to permit installation of said edge hook over the hinge edge of said vehicle door while said door is closed.

10. A vehicle and banner assembly comprising:

a motor vehicle comprising a door said door including a hinge edge, an entry edge and an exterior surface, and said motor vehicle comprising a body part adjacent the hinge edge of the door;

said banner assembly comprising:

a banner constructed of thin flexible material, said banner having a height H of approximately 12 to 18 inches and leading and trailing edges separated by a length L;

leading edge fixture means for securing the leading edge of the banner to the hinge edge of the door, said fixture means comprising a pocket substantially traversing the height H of said banner and an elongated retainer received in said pocket, wherein said pocket and elongate retainer secure the trailing edge of the banner to the door by being trapped between the hinge edge of the door and said body part;

at least one band extending from the trailing edge of said banner; and trailing edge fixture means connected to said at least one band for securing the trailing edge of the banner to the entry edge of the door;

wherein said leading edge fixture means, adjustment means, and trailing edge fixture means are employed to retain said banner securely to said vehicle door and said banner generally conforms to the door exterior surface.

11. The vehicle and banner assembly of claim 10, wherein said at least one band comprises at least one elastic band affixed to the trailing edge of said banner.

12. The vehicle and banner assembly of claim 10, wherein said at least one band comprises at least one non-elastic band having a band length, the band length of which being adjustable.

13. The vehicle and banner assembly of claim 10, wherein there are two bands and said trailing edge fixture means comprises rear hooks configured for hooked engagement with the entry edge of the door, said rear hooks being affixed to the bands.

14. The vehicle and banner assembly of claim 10 wherein said height H is approximately 15 inches.

15. A vehicle banner assembly for display on a door of a motor vehicle, said door including a hinge edge an entry edge and an exterior surface, said vehicle banner assembly comprising:

a banner constructed of thin flexible material said banner having a height H of approximately 12 to 18 inches and leading and trailing edges separated by a length L;

leading edge fixture means for securing the leading edge of the banner to the hinge edge of the door, wherein said leading edge fixture means comprises an edge hook having a length approximately equal to the height H of said banner, said edge hook including an edge catch traversing said length and a hook body, said edge hook configured for hooked engagement with the hinge edge of the door, and said hook body configured to receive and securely retain the leading edge of said banner;

at least one band extending from the trailing edge of said banner; and trailing edge fixture means connected to said at least one band for securing the trailing edge of the banner to the entry edge of the door;

wherein said leading edge fixture means and said trailing edge fixture means are employed to retain said banner securely to said vehicle door and said banner generally conforms to the door exterior surface.

16. The vehicle banner assembly of claim 15, wherein said edge hook body is hollow and extends the length of said edge hook, said body including a slot traversing the length of said body and said vehicle banner assembly further comprises an elongate retainer, wherein said leading edge is inserted through said slot and said elongate retainer is inserted into said hollow body, whereby said leading edge is retained in said body.

17. The vehicle banner assembly of claim 15, wherein said edge hook body comprises two hinged wings, each said wing equipped with means for retaining the leading edge of said banner between said wings and means for retaining one wing to the other wing, wherein said leading edge of said banner is inserted between said wings and said wings are closed, whereby said leading edge is retained between said wings.

18. The vehicle banner assembly of claim 15, wherein said edge catch is flared to permit installation of said edge hook over the hinge edge of said vehicle door while said door is closed.

* * * * *

UNITED STATES PATENT AND TRADEMARK OFFICE

CERTIFICATE OF CORRECTION

PATENT NO. : 6,588,133 B1
DATED : July 8, 2003
INVENTOR(S) : Garrity

It is certified that error appears in the above-identified patent and that said Letters Patent is hereby corrected as shown below:

Column 7,
Line 27, after "said" insert -- leading edge is retained between said wings --.

Signed and Sealed this

Third Day of August, 2004

JON W. DUDAS
*Acting Director of the United States Patent and Trademark Office*